US011805831B2

(12) United States Patent
Rafn

(10) Patent No.: US 11,805,831 B2
(45) Date of Patent: Nov. 7, 2023

(54) VENTED UPPER-BODY GARMENT

(71) Applicant: NIKE, Inc., Beaverton, OR (US)

(72) Inventor: Ronald David Rafn, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 112 days.

(21) Appl. No.: 17/008,882

(22) Filed: Sep. 1, 2020

(65) Prior Publication Data

US 2021/0137192 A1 May 13, 2021

Related U.S. Application Data

(60) Provisional application No. 62/934,829, filed on Nov. 13, 2019.

(51) Int. Cl.
*A41D 27/28* (2006.01)
*A41D 31/14* (2019.01)

(52) U.S. Cl.
CPC ..... *A41D 27/28* (2013.01); *A41D 31/145* (2019.02)

(58) Field of Classification Search
CPC ..... A41D 27/28; A41D 1/02; A41D 1/085; A41D 31/145; A41D 3/04
See application file for complete search history.

(56) References Cited

U.S. PATENT DOCUMENTS 1,562,767 A 11/1925 David
2,010,434 A 8/1935 Langrock
2,247,180 A 6/1941 Bagnato
2,259,560 A 10/1941 Glidden
3,296,626 A 1/1967 Ludwikowski
4,408,356 A 10/1983 Abrams
4,665,563 A 5/1987 Harvey
5,088,116 A 2/1992 Gould
5,269,862 A 12/1993 Nakajima et al.
6,052,826 A 4/2000 Tolton
7,043,767 B2 5/2006 Jaeger
9,204,671 B1 * 12/2015 Kessler, III ..... A41B 1/08
9,974,346 B2 5/2018 Beneyto-Ferre
10,244,804 B2 4/2019 Hodgson et al.
2009/0265829 A1 * 10/2009 Gomes Seguin ..... A41D 27/28 2/87
2011/0296580 A1 12/2011 Demarest et al.
(Continued)

FOREIGN PATENT DOCUMENTS

CN 2205118 Y 8/1995
CN 2747908 Y 12/2005
(Continued)

OTHER PUBLICATIONS

English translation of JP10273803 to Matsumoto, via espacnet.com (last visited Mar. 31, 2022). (Year: 2022).*
(Continued)

*Primary Examiner* — Patrick J. Lynch
(74) *Attorney, Agent, or Firm* — SHOOK, HARDY & BACON L.L.P.

(57) ABSTRACT

Aspects herein are directed to a vented upper-body garment that includes a plurality of panels that extend across a back aspect of a torso region of the garment, around first and second sides of the torso region, and at least partially across
(Continued)

a front aspect of the torso region. Respective edges of the panels overlap each other to form vent openings that facilitate the flow of air into and out of the garment.

19 Claims, 5 Drawing Sheets

(56) References Cited

U.S. PATENT DOCUMENTS

| | | | | |
|---|---|---|---|---|
| 2016/0242474 | A1* | 8/2016 | Baschak | A41D 31/102 |
| 2017/0197107 | A1 | 7/2017 | Parkinson | |

FOREIGN PATENT DOCUMENTS

| | | | | | |
|---|---|---|---|---|---|
| DE | 19749436 | A1 | | 5/1999 | |
| EP | 2578097 | A1 | | 4/2013 | |
| GB | 428286 | A | * | 4/1935 | A41D 27/28 |
| GB | 463058 | A | | 3/1937 | |
| GB | 540546 | A | | 10/1941 | |
| GB | 2327858 | A | * | 2/1999 | A41D 27/28 |
| JP | 7-157908 | A | | 6/1995 | |
| JP | 07331516 | A | * | 12/1995 | A41D 27/28 |
| JP | 10273803 | A | * | 10/1998 | A41D 27/28 |
| KR | 101519102 | B1 | * | 5/2015 | A41D 27/28 |
| RU | 2318415 | C1 | | 3/2008 | |
| WO | 2014/118558 | A1 | | 8/2014 | |
| WO | WO-2016199322 | A1 | * | 12/2016 | A41D 27/28 |

OTHER PUBLICATIONS

English translation of WO2016199322 to Miyaguni, obtained via espacenet.com (last visited Jul. 28, 2022) (Year: 2022).*

International Search Report and Written Opinion received for PCT Patent Application No. PCT/US2020/051970, dated Jan. 25, 2021, 15 pages.

"Craft Sportswear Women's Repel Running and Training Outdoor Sport Windproof and Waterproof Reflective Fitted Hooded Jacket", Amazon, ASIN: B06XNNZ1ST, Item model No. 1905415, Mar. 16, 2017, 5 pages.

"Fløyen W Jacket", Bergans, Apr. 2, 2019, 4 pages.

Glass, "First impressions: Craft women's 2013 road cycle clothing range", Oct. 1, 2013, 3 pages.

"Mist Wind Jacket M", Art nr. 1906093-999000,, Last accessed: Apr. 2019, 1 page.

"Naughtvind Jacket, Winter Cycling Shell Jacket", Nov. 19, 2017, 4 pages.

"Nike Men's AeroShield Jacket", Nike, Model No. 928477-010, Apr. 2, 2019, 2 pages.

International Preliminary Report on Patentability received for PCT Patent Application No. PCT/US2020/051970, dated May 27, 2022, 8 pages.

* cited by examiner

VENTED UPPER-BODY GARMENT

CROSS-REFERENCE TO RELATED APPLICATIONS

This application, assigned U.S. application Ser. No. 17/008,882, filed Sep. 1, 2020, and entitled "Vented Upper-Body Garment," claims the benefit of priority of U.S. Prov. App. No. 62/934,829, filed Nov. 13, 2019, and entitled "Vented Upper-Body Garment." The entirety of the aforementioned application is incorporated by reference herein.

TECHNICAL FIELD

Aspects herein related to a vented upper-body garment.

BACKGROUND

Inflow and outflow vents on typical upper-body garments may not be strategically located and/or constructed to maximize the flow of air into the garment and/or the flow of air out of the garment in order to cool a wearer while still preventing, for example, precipitation from entering the garment. Inflow and outflow vents may also not be constructed to minimize material waste.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An upper-body garment with a torso region having a first sleeve opening, and a second sleeve opening, the upper-body garment comprising: a plurality of panels extending across a back aspect of the torso region and around a first side and a second opposite side of the torso region inferior to the first sleeve opening and the second sleeve opening respectively, each of the plurality of panels including a first terminal end and a second terminal end; and at least a first front panel extending across a first reference line that passes through the first terminal end of at least one of the plurality of panels and is parallel to a front midline of the upper-body garment.

Clause 2. The upper-body garment of clause 1, further comprising a second front panel extending across a second reference line that passes through the second terminal end of the at least one of the plurality of panels and is parallel to the front midline of the upper-body garment.

Clause 3. The upper-body garment according to any of clauses 1 through 2, wherein the plurality of panels include an upper panel having a bottom edge, and a lower panel having a top edge, and wherein the bottom edge of the upper panel overlaps the top edge of the lower panel to form a vent opening between the bottom edge and the top edge.

Clause 4. The upper-body garment of clause 3, wherein the bottom edge of the upper panel includes a first undulating pattern as the bottom edge extends across the back aspect of the torso region, and wherein the top edge of the lower panel includes a second undulating pattern as the top edge extends across the back aspect of the torso region.

Clause 5. The upper-body garment of clause 4, wherein the first undulating pattern is substantially the same as the second undulating pattern.

Clause 6. The upper-body garment according to any of clauses 3 through 5, further comprising a plurality of securement points between the bottom edge of the upper panel and the top edge of the lower panel, the plurality of securement points subdividing the vent opening into a plurality of sub-vent openings.

Clause 7. The upper-body garment of clause 6, wherein a first sub-vent opening of the plurality of sub-vent openings comprises a reinforcement strip extending along a portion of the bottom edge of the upper panel, the reinforcement strip maintaining the first sub-vent opening in an open state.

Clause 8. The upper-body garment of clause 7, wherein the first sub-vent opening is located on a front aspect of the upper-body garment.

Clause 9. The upper-body garment according to any of clauses 7 through 8, wherein a longitudinal axis of the first sub-vent opening is oriented substantially parallel to the first reference line.

Clause 10. An upper-body garment with a torso region having a first sleeve opening, and a second sleeve opening, the upper-body garment comprising: an upper panel having a bottom edge and extending across a back aspect of the torso region and around a first side and a second opposite side of the torso region, wherein the bottom edge of the upper panel includes a first undulating pattern as the bottom edge extends across the back aspect; and a lower panel having a top edge and extending across the back aspect of the torso region and around the first side and the second opposite side of the torso region, wherein the top edge includes a second undulating pattern as the top edge extends across the back aspect, wherein the bottom edge of the upper panel overlaps the top edge of the lower panel to form a vent opening between the bottom edge and the top edge.

Clause 11. The upper-body garment of clause 10, wherein each of the upper panel and the lower panel extend around the first side and the second opposite side of the torso region inferior to the first sleeve opening and the second sleeve opening respectively.

Clause 12. The upper-body garment according to any of clauses 10 through 11, wherein at least the lower panel includes a first terminal end and a second terminal end, and wherein the first terminal end and the second terminal end are located on a front aspect of the torso region.

Clause 13. The upper-body garment of clause 12, wherein the first terminal end is spaced from a front midline of the upper-body garment by a first front panel, and wherein the second terminal end is spaced from the front midline of the upper-body garment by a second front panel.

Clause 14. The upper-body garment of clause 13, wherein the first front panel extends across a first reference line that passes through the first terminal end and is parallel to the front midline of the upper-body garment, and wherein the second front panel extends across a second reference line that passes through the second terminal end and is parallel to the front midline of the upper-body garment.

Clause 15. The upper-body garment according to any of clauses 10 through 14, further comprising a plurality of securement points between the bottom edge of the upper panel and the top edge of the lower panel, the plurality of securement points subdividing the vent opening into a plurality of sub-vent openings.

Clause 16. The upper-body garment of clause 15, wherein the plurality of sub-vent openings include a first sub-vent opening positioned on a front aspect of the upper-body garment, and wherein a longitudinal axis of the first sub-vent opening is oriented substantially parallel to a front midline of the upper-body garment.

Clause 17. The upper-body garment of clause 16, wherein the first sub-vent opening comprises a reinforcement strip extending along a portion of the bottom edge of the upper panel, the reinforcement strip maintaining the first sub-vent opening in an open state.

Clause 18. A method of manufacturing a vented portion of an upper-body garment with a torso region having a first sleeve opening, and a second sleeve opening, the method of manufacturing comprising: positioning an upper panel such that it extends across a back aspect of the torso region and around a first side and a second opposite side of the torso region, the upper panel having a bottom edge that includes a first undulating pattern as the bottom edge extends across the back aspect; positioning a lower panel such that it extends across the back aspect of the torso region and around the first side and the second opposite side of the torso region, the lower panel having a top edge that includes a second undulating pattern as the top edge extends across the back aspect, wherein the upper panel and the lower panel are positioned so that the bottom edge of the upper panel overlaps the top edge of the lower panel to form a vent opening; and securing the bottom edge of the upper panel to the top edge of the lower panel at one or more spaced-apart securement points to form the vented portion of the upper-body garment.

Clause 19. The method of manufacturing the vented portion of the upper-body garment of clause 18, wherein each of the upper panel and the lower panel extend around the first side and the second opposite side of the torso region inferior to the first sleeve opening and the second sleeve opening respectively.

Clause 20. The method of manufacturing the vented portion of the upper-body garment according to any of clauses 18 through 19, wherein the first undulating pattern is substantially the same as the second undulating pattern.

BRIEF DESCRIPTION OF THE DRAWINGS

Examples of aspects herein are described in detail below with reference to the attached drawing figures, wherein.

DETAILED DESCRIPTION

Figure 2:
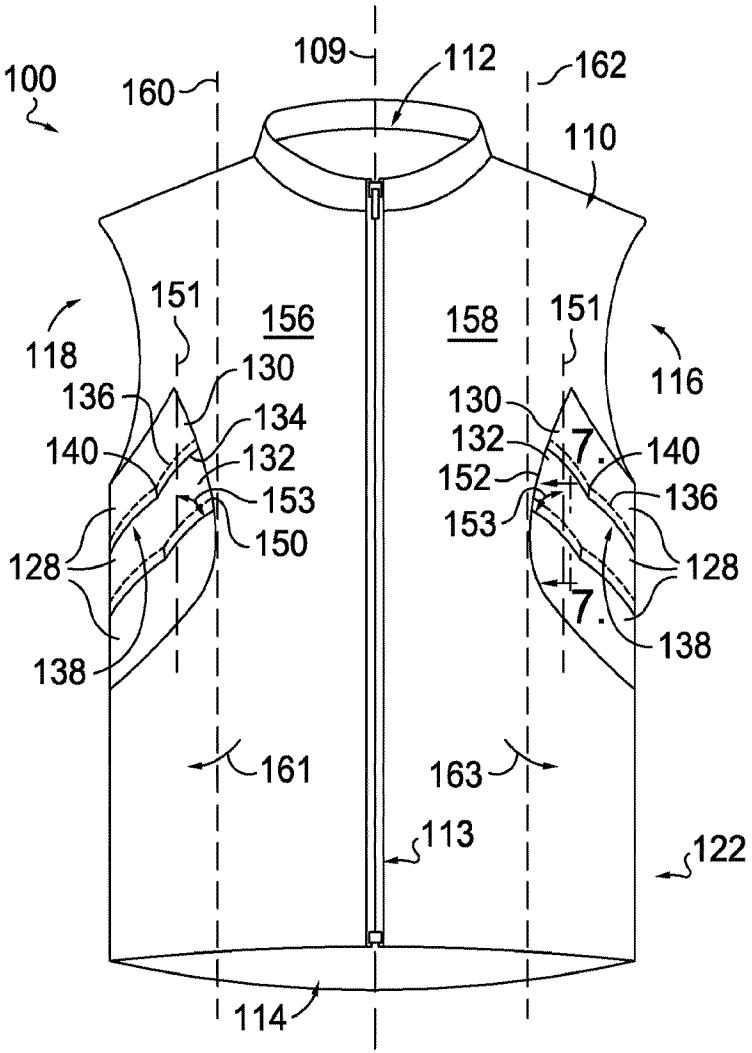
FIG. 2 illustrates a front view of the vented upper-body garment of FIG. 1 in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Vents on upper-body garments may include both inflow vents located, for instance, on the front of the upper-body garment that channel air into the space between the garment and the wearer to cool the wearer and outflow vents located, for instance, on the back of the upper-body garment that channel heated air out of the space between the garment and the wearer to further help cool the wearer. Outflow vents on typical upper-body garments are generally offset from or spaced apart from inflow vents by one or more panels of materials that do not include vents. This configuration may retain heated air in the garment for a prolonged period of time. Moreover, when forming the inflow and outflow vents on typical upper-body garments, a first set of panel pieces are generally used to form the inflow vents, and a second separate set of panel pieces are generally used to form the outflow vents which may increase materials costs and manufacturing times. Aspects herein contemplate an upper-body garment with a vented portion formed using overlapping panels that extend substantially horizontally across a back aspect of the garment, around the sides of the garment, and at least partially across a front aspect of the garment. Thus, the same set of panels form both the inflow vents and the outflow vents on the garment which helps to decrease manufacturing time, costs, and material waste. This configuration also results in the outflow vents continuously extending from the inflow vents (i.e., there is no intervening panel(s) between the inflow and outflow vents), so that heated air may more quickly escape the garment. In addition, overlapping the panels helps to prevent precipitation from entering the garment.

At a high level, aspects herein are directed to an upper-body garment having a vented portion formed from two or more panels that extend across a back aspect of a torso region of the garment and further extend around a first side and a second side of the torso region. The panels have terminal ends that are positioned on a front aspect of the torso region. The panels are positioned such that, for example, a bottom edge of an upper panel overlaps a top edge of a lower panel to form a vent opening between the respective edges. In example aspects, the vent opening may be subdivided into a number of sub-vents by securing the bottom edge of the upper panel to the top edge of the lower panel at one or more spaced-apart securement points. By utilizing panels that extend across the back aspect, around the first side and second side of the torso region, and terminate on the front aspect of the torso region, both inflow vents and outflow vents are formed using the same set of panels. Further, by having the outflow vents continuously extend from the inflow vents, air that enters the garment by way of the inflow vents and is heated by the wearer may quickly escape the garment by way of the outflow vents.

In example aspects, the panels are shaped so that the bottom edge of the upper panel and the top edge of the lower panel each have an undulating pattern as the panels extend across the back aspect of the torso region. Use of an undulating pattern for both of the edges as opposed to, for example, the upper panel and/or the lower panel having linear edges, creates a vent opening oriented along multiple, different axes. This, in turn, creates different egress routes for air to escape the garment which may provide more efficient venting. The panels may be further shaped so that they angle up toward the neck opening of the garment as the panels extend around the sides of the torso region and terminate on the front aspect of the torso region. Having a more vertically oriented vent opening on the front aspect of the garment may prevent the vent opening from collapsing as wearer runs or moves in a forward direction which, in turn, facilitates the flow of air into the garment.

As used herein, the term "upper-body garment" encompasses garments meant to be worn on an upper torso of a wearer and may include shirts, jackets, hoodies, pullovers, vests, coats, and the like. Positional terms used when describing the upper-body garment such as front, back, sides, upper, lower, top, bottom, front midline, and the like are with respect to the upper-body garment being worn as intended with the wearer standing upright. As such, when the upper-body garment described herein is worn, a back aspect of the garment is configured to cover a back upper torso area of the wearer or the back of the wearer's arms, a front aspect of the garment is configured to cover a front upper torso area of the wearer or the front of the wearer's arms, and the sides of the garment are configured to cover the side torso areas of the wearer (i.e., the areas extending distally from the wearer's underarm areas). A panel that is described as an "upper panel" is located closer to a neck opening of the garment than a panel that is described as a "lower panel." To state this differently, a panel that is described as a "lower panel" is located closer to a waist opening of the garment than a panel that is described as an "upper panel." The term "front midline" or "back midline" as used herein means a vertically oriented midline (i.e., a midline that extends from a neck opening to a waist opening of the garment) that divides the upper-body garment into generally equal right and left halves. The term "substantially horizontal" when describing how the panels extends across, for instance, the back aspect of the garment means that a longitudinal axis of the panel is oriented perpendicular (within ±20 degrees) to the front midline and/or the back midline.

The term "vent" or "vent opening" as used herein means an opening formed in the upper-body garment that provides a fluid (e.g., gas, liquid) communication path between the external environment and the interior of the garment (e.g., the space between the inner-facing surface of the garment and the wearer's body). When using the terms "inflow vent" and "outflow vent" throughout the disclosure, it is contemplated that both encompass a vent opening formed in the upper-body garment but the function of each may differ depending on the location of the vent on the upper-body garment. For example, as used herein, an inflow vent is generally positioned on a portion of the garment that is exposed to a prevailing wind flow caused by, for example, wearer movement. In an example scenario, the inflow vent is positioned on the front aspect of the torso region of the garment to capture and funnel air into the garment when the wearer is moving in a forward direction (e.g., running). An outflow vent is generally positioned on a portion of the garment that is not exposed to the prevailing wind flow caused by the wearer movement. Thus, in the example scenario above, the outflow vent is generally positioned on the sides or the back aspect of the garment to act as an egress point for air to leave the interior of the garment and exhaust into the external environment. The term "longitudinal axis" used when describing the vent opening is an axis that is parallel to the longest dimension of the vent opening. To state this differently, the "longitudinal axis" of a vent opening linearly extends between adjacent securement points. The term "substantially parallel" when describing the orientation of vent opening relative to, for instance, the front midline of the garment means that the longitudinal axis of the vent opening is oriented within ±30 degrees of parallel with respect to the front midline.

The term "undulating pattern" as used herein to describe, for example, the bottom edge of the upper panel and the top edge of the lower panel as they extend across the back aspect of the upper-body garment, means a pattern formed from a series of continuous, non-parallel and optionally alternating line segments where the line segments may be linear, curvilinear, curved, or a combination thereof. Thus, the undulating pattern may comprise a zig-zag pattern, a scalloped pattern, a sine wave pattern, and the like including combinations thereof. The term "undulating pattern" is not meant to be limiting but, instead, is meant to convey a pattern other than a continuous straight line or a continuous linear edge. The term "substantially the same" when describing that the undulating pattern of the bottom edge of the upper panel is substantially the same as the top edge of the lower panel means that the patterns share a geometric similarity although the dimensions of each may be slightly different. Thus, if the bottom edge of the upper panel includes a zig-zag pattern, then the top edge of the lower panel includes a zig-zag pattern. In another example, if the bottom edge of the upper panel includes a scalloped pattern, then the top edge of the lower panel includes a scalloped pattern.

The term "terminal end" used when describing the panels that form the inflow and outflow vents means the edge of a panel that is continuously joined or seamed to one or more front panels of the upper-body garment where the one or more front panels form the front aspect of the upper-body garment. Unless indicated otherwise, all measurements provided herein are with respect to the garment in a resting state (i.e., a non-stretched) state at standard ambient temperature and pressure (298.15 K and 100 kPa).

Figure 1:
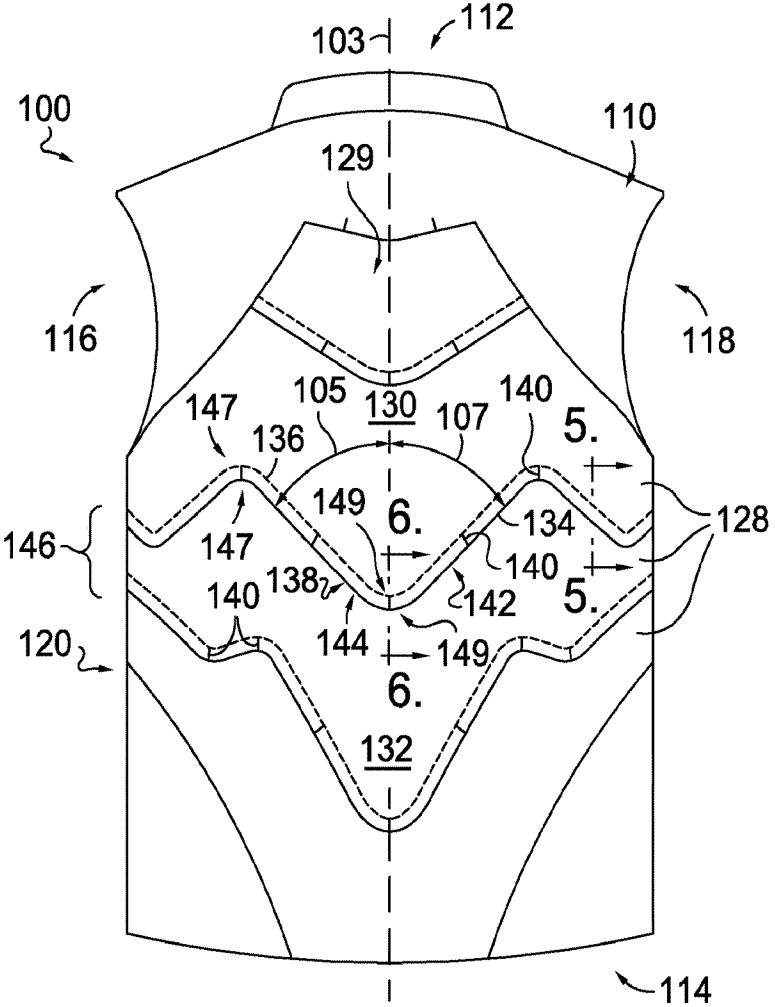
FIG. 1 illustrates a back view of an example vented upper-body garment in accordance with aspects herein.

FIGS. 1-4 illustrate a back view, a front view, a first side view, and a second side view respectively of a vented upper-body garment 100. The vented upper-body garment 100 includes a torso region 110 having a neck opening 112, a waist opening 114, a first sleeve opening 116, and a second sleeve opening 118. The torso region 110 may optionally include a closure mechanism 113 (shown in FIG. 2), such as a slider mechanism, that releasably secures a first front panel 156 of the torso region 110 with a second front panel 158 of the torso region 110. Although shown without sleeves, it is contemplated herein that the vented upper-body garment 100 may include sleeves such as long sleeves, three-quarter sleeves, half sleeves, one-quarter sleeves, and the like. A back aspect 120 of the torso region 110 is shown in FIG. 1, a front aspect 122 of the torso region 110 is shown in FIG.

Figure 4:
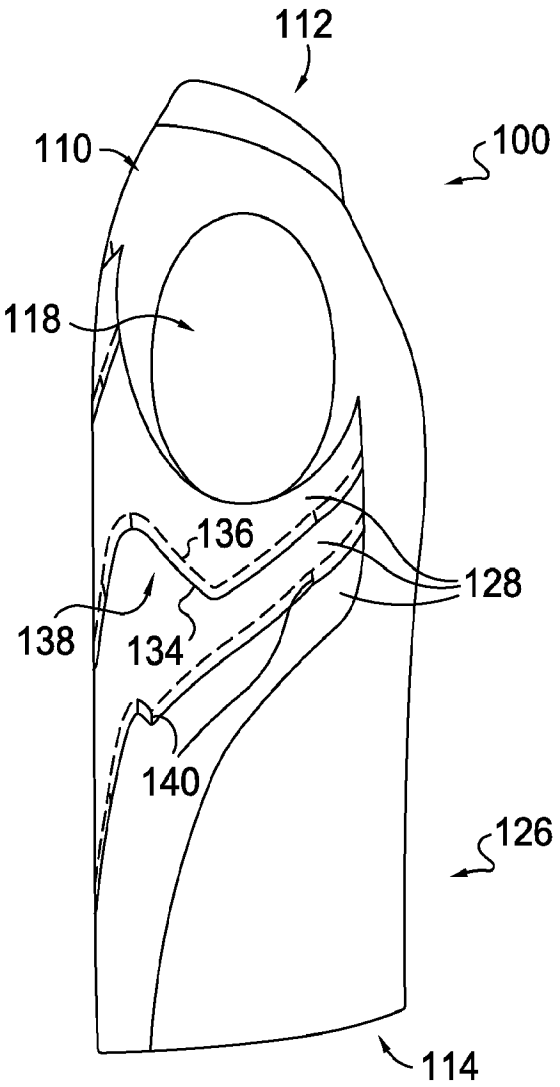
FIGS. 3-4 illustrate respective side views of the vented upper-body garment of FIG. 1 in accordance with aspects herein.
Figure 3:
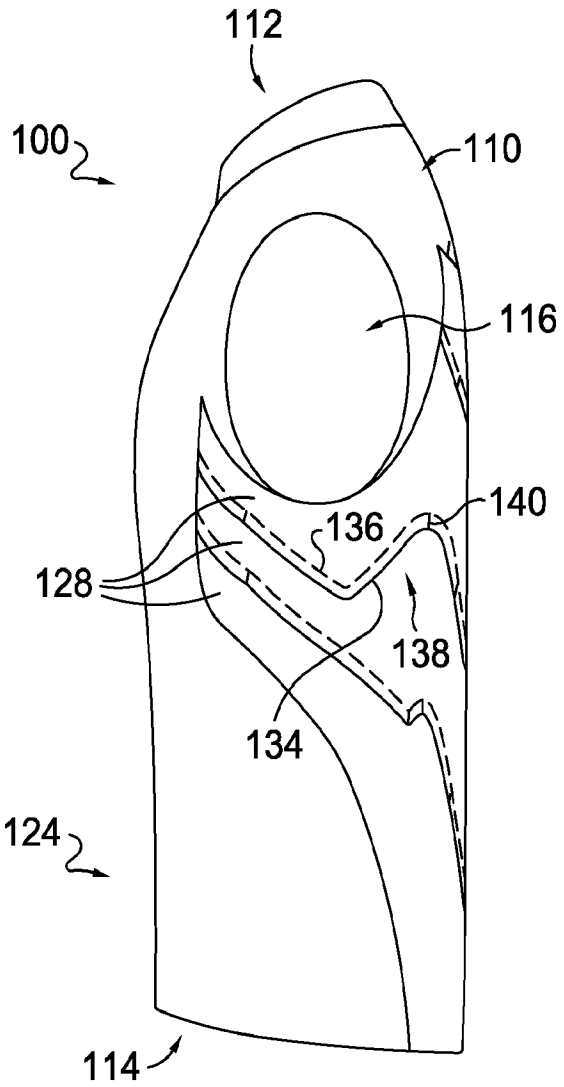

2, a first side 124 of the torso region 110 is shown in FIG. 3, and a second opposite side 126 of the torso region 110 is shown in FIG. 4.

In example aspects, the upper-body garment 100 may be formed of a lightweight fabric (e.g., from about 30 grams per square meter (gsm) to about 150 gsm) or an ultra-lightweight fabric (e.g., from about 10 gsm to about 100 gsm). As used herein, the term about means within ±5% of an indicated value. The fabric may include a woven textile, and in example aspects, the woven textile may be water-resistant. For example, the woven textile may be treated with a durable water repellant (DWR) finish although other ways of making the woven textile water resistant are contemplated herein. As thus described, the upper-body garment 100 may be suitable for exercising and/or athletic activities in adverse weather conditions (e.g., rain). It is also contemplated herein that the vented upper-body garment 100 may be formed of heavier weight materials, other constructions such as a knit textile or a non-woven textile, and/or may not be water-resistant. Any and all aspects, and any variation thereof, are contemplated as being within aspects herein.

As shown in FIGS. 1-4, the torso region 110 includes a vented portion formed from a plurality of panels 128 that extend substantially horizontally across the back aspect 120 of the torso region 110 (shown in FIG. 1), around the first side 124 inferior to the first sleeve opening 116 (shown in FIG. 3) and the second side 126 inferior to the second sleeve opening 118 (shown in FIG. 4), and at least partially extend across the front aspect 122 of the torso region 110. The plurality of panels 128 may further include panels, such as panel 129 that is located solely on, for instance, the back aspect 120 of the torso region 110. The positioning of the plurality of panels 128 as described and illustrated herein may be based on, for example, heat, sweat, and air flow maps of a human. Thus, these maps may indicate that air flows across the front of humans when, for instance, the humans engage in a running motion, and that humans typically sweat more and/or produce more heat along the torso sides and back. Strategically locating the plurality of panels 128 at these areas may also simplify construction of the upper-body garment 100 and decrease material waste. A description will now be provided for an upper panel 130 and a lower panel 132 of the plurality of panels 128 although it is contemplated herein that the description may be applicable to other panels of the plurality of panels 128.

The upper panel 130 includes at least a bottom edge 134, and the lower panel 132 includes at least a top edge 136 (shown in dashed line to indicate it is generally hidden from view by the upper panel 130). The upper panel 130 and the lower panel 132 are arranged such that the bottom edge 134 of the upper panel 130 overlaps the top edge 136 of the lower panel 132 to form a vent opening 138 which continuously extends across the back aspect 120 of the torso region 110, around the first side 124 and the second side 126 of the torso region 110, and partially across the front aspect 122 of the torso region 110. More specifically, the bottom edge 134 of the upper panel 130 is positioned external to the top edge 136 of the lower panel 132. Overlapping the panel edges and orienting the panels in a substantially horizontal orientation may help to prevent precipitation from entering the upper-body garment 100 when the wearer is exercising in rainy conditions.

In example aspects, the bottom edge 134 of the upper panel 130 may be secured using, for instance, stitching, tacking, adhesive, spot welding, bonding, and the like to the top edge 136 of the lower panel 132 at a plurality of spaced-apart securement points 140 thus dividing the vent opening 138 into a plurality of sub-vent openings such as sub-vent openings 142 and 144, where a respective sub-vent opening extends between adjacent securement points 140. The spacing between the securement points 140 may be selected to maximize the amount of air entering and leaving the upper-body garment 100 while minimizing opportunities for the vent opening 138 to snag or rip or to make the upper-body garment 100 difficult to don or doff which may occur if the vent opening 138 is too large. In example aspects, the spacing between the securement points 140 may range from about 30 cm to about 5 cm, from about 20 cm to about 8 cm, or from about 15 cm to about 10 cm. In example aspects, the vent opening 138 and/or sub-vent openings positioned on the front aspect 122 of the torso region 110 may function as inflow vents directing air into the upper-body garment 100, and the vent opening 138 and/or sub-vent openings positioned on the back aspect 120 of the torso region 110 may function as outflow vents for air to escape the upper-body garment 100.

As shown in FIG. 1, the bottom edge 134 of the upper panel 130 and the top edge 136 of the lower panel 132 each have an undulating pattern referenced generally by the numeral 146 as the upper panel 130 and the lower panel 132 extend substantially horizontally across the back aspect 120 of the torso region 110. In example aspects shown in FIG. 1, the undulating pattern 146 includes a series a "peaks," such as peak 147 and "troughs," such as trough 149 although other patterns are contemplated herein (e.g., sine wave, scalloped, and the like). The undulating pattern 146 is substantially the same for both the bottom edge 134 of the upper panel 130 and the top edge 136 of the lower panel 132. In example aspects, the peaks associated with the bottom edge 134 of the upper panel 130 are vertically aligned with the peaks associated with the top edge 136 of the lower panel 132, and the troughs associated with the bottom edge 134 of the upper panel 130 are vertically aligned with the troughs associated with the top edge 136 of the lower panel 132.

Use of substantially the same undulating pattern 146 for both the bottom edge 134 of the upper panel 130 and the top edge 136 of the lower panel 132 and vertically aligning the peaks and troughs of the respective upper and lower panels 130 and 132 facilitates minimal overlap between the respective bottom and top edges 134 and 136, which may lead to more efficient venting. This is opposed to, for example, use of an undulating pattern for a bottom edge of an upper panel and a linear edge for a top edge of a lower panel (or vice versa), which may create excess overlap between the panel edges and less efficient venting. Additionally, use of the undulating pattern 146 for both the bottom edge 134 of the upper panel 130 and the top edge 136 of the lower panel 132 orients the vent opening 138 along multiple, different axes. For example, sub-vent opening 142 is positively sloped (e.g., from about 10 degrees to about 80 degrees) with respect to a back midline 103 as indicated by reference numeral 107, and the sub-vent opening 144 is negatively sloped (e.g., from about negative 10 degrees to about negative 80 degrees) with respect to the back midline 103 as indicated by reference numeral 105. Orienting the vent opening 138 along multiple, different axes creates different egress routes for air to escape the upper-body garment 100 which may provide more efficient venting.

FIG. 2 illustrates the upper panel 130 and the lower panel 132 angling up in the direction of the neck opening 112 as the panels 128 extend at least partially across the front aspect 122 of the torso region 110. Said differently, the upper panel 130 and the lower panel 132 are oriented more vertically as the upper and lower panels 130 and 132 extend across the front aspect 122 of the torso region 110. This, in turn, causes a longitudinal axis of the vent opening 138 to be oriented more vertically (e.g., from about 0 degree to about ±30 degrees from a vertical axis 151 that passes through the longitudinal axis of the vent opening 138 as indicated by reference numeral 153) as the upper and lower panels 130 and 132 extend across the front aspect 122 of the torso region 110. In example aspects, the longitudinal axis of the vent opening 138 may be substantially parallel to a front midline 109 of the upper-body garment 100. Orienting the longitudinal axis of the vent opening 138 more vertically as opposed to horizontally may help to prevent the vent opening 138 from collapsing when exposed to prevailing winds thus facilitating the capture of air traveling over the front aspect 122 of the upper-body garment 100.

Figure 7:
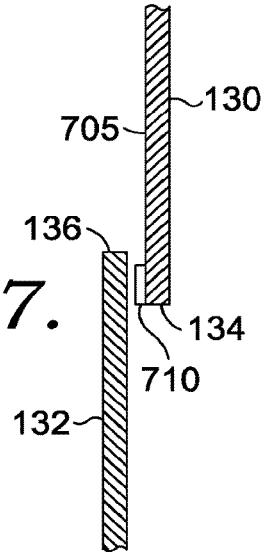
FIG. 7 illustrates a cross-section of a vent including a reinforcement strip taken along cut line 7-7 of FIG. 2 in accordance with aspects herein.
Figure 8:
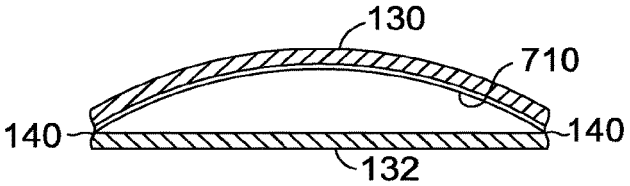
FIG. 8 illustrates a view of a vent opening including a reinforcement strip taken along a longitudinal axis of the vent opening in accordance with aspects herein.

In example aspects, and as described further with respect to FIGS. 7 and 8, the bottom edge 134 of the upper panel 130 may be reinforced with a reinforcing strip to help maintain the vent opening 138 and/or the sub-vent openings in a permanently open state on the front aspect 122 of the torso region 110. In example aspects, the use of one or more reinforcing strips may be limited to the vent opening 138 and/or sub-vent openings positioned on the front aspect 122 of the torso region 110, although aspects herein further contemplate use of one or more reinforcing strips on the back aspect 120 of the torso region 110 and/or the first side 124 and the second side 126 of the torso region 110. Any and all aspects, and any variation thereof, are contemplated as being within aspects herein.

The upper panel 130 and the lower panel 132 each include terminal ends positioned on the front aspect 122 of the torso region. For instance, the lower panel 132 includes a first terminal end 150 and a second terminal end 152. As shown in FIG. 2, the first terminal end 150 is spaced apart from the front midline 109 of the torso region 110 by the first front panel 156, and the second terminal end 152 is spaced apart from the front midline 109 of the torso region 110 by the second front panel 158. In example aspects, the first front panel 156 and the second front panel 158 may comprise separate panel pieces releasably secured together using the optional closure mechanism 113. In other aspects, the first front panel 156 and the second front panel 158 may comprise a single pattern piece in which case the upper-body garment 100 would not include the closure mechanism 113. In example aspects, the first front panel 156 and the second front panel 158 extend around to the first side 124 and the second side 126 of the torso region 110 inferior to the plurality of panels 128. To describe this differently, the first front panel 156 extends across (e.g., in a medial-to-lateral direction) a first reference line 160 that passes through the first terminal end 150 of the lower panel 132 and is parallel to the front midline 109 of the upper-body garment 100 as indicated by arrow 161. The second front panel 158 extends across (e.g., in a medial-to-lateral direction) a second reference line 162 that passes through the second terminal end 152 and is parallel to the front midline 109 of the upper-body garment 100 as indicated by arrow 163. The configuration described may help to minimize the number of panel pieces needed to form the vented upper-body garment 100.

As depicted in FIGS. 1-4, the vent opening 138 continuously extends from the front aspect 122 of the upper-body garment 100 to the back aspect 120 of the upper-body garment 100. Having a continuous vent opening 138 that can function as both an inflow vent (when, for instance, located on the front aspect 122 of the garment 100) and as an outflow vent (when, for instance, located on the back aspect 120 of the garment 100) minimizes the number of pattern pieces needed to form, for example, separate inflow vents and outflow vents. In addition, having a continuous vent opening 138 facilitates a continuous flow of air into and out of the upper-body garment 400. Thus, air entering the garment 100 by way of the vent opening 138 positioned on the front aspect 122 of the upper-body garment 100 may exit the upper-body garment 100 by way of the vent opening 138 positioned on the first side 124, the second side 126, or the back aspect 120 of the upper-body garment 100. In one illustrative example, a volume of air entering the garment 100 by way of the vent opening 138 positioned on the front aspect 122 may be heated by the wearer. The warmed air may begin exiting the garment 100 by way of the vent opening 138 positioned on the first side, 124, the second side 126, and the lateral sides of the back aspect 120 of the torso region 110. Air that is retained in the garment 100 may continue to be heated and finish exiting the garment 100 by way of the vent opening 138 positioned at a central area of the back aspect 120 of the torso region 110. The continuous exhaust of warmed air along the first and second sides 124 and 126, and the back aspect 120 of the garment 100 may allow for more efficient venting and cooling of the wearer.

Figure 5:
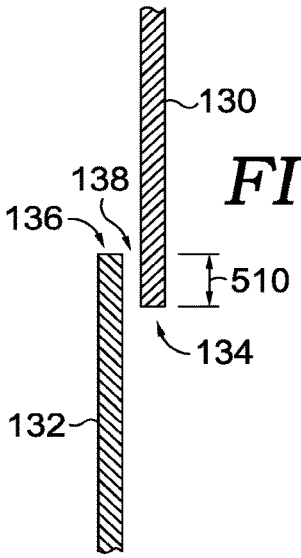
FIG. 5 illustrates a cross-section of a vent taken at cut line 5-5 of FIG. 1 in accordance with aspects herein.

FIG. 5 illustrates a cross-section of the vent opening 138 taken along cut line 5-5 in FIG. 1. FIG. 5 depicts the bottom edge 134 of the upper panel 130 overlapping the top edge 136 of the lower panel 132 to form the vent opening 138. The vent opening 138 represents an area where the bottom edge 134 of the upper panel 130 is not affixed to, or is unaffixed from, the top edge 136 of the lower panel 132 to provide a fluid communication path between an environment external to the upper-body garment 100 and an environment internal to the upper-body garment 100. Overlapping the edges of the panels may prevent precipitation from entering the upper-body garment 100. As shown, the bottom edge 134 of the upper panel 130 is positioned external to the top edge 136 of the lower panel 132. The amount of overlap between the bottom edge 134 of the upper panel 130 and the top edge 136 of the lower panel is indicated by reference numeral 510. The amount of overlap can range from about 5 cm to about 4 mm, from about 4 cm to about 6 mm, from about 3 cm to about 8 mm, or from about 2 cm to about 1 cm.

Figure 6:
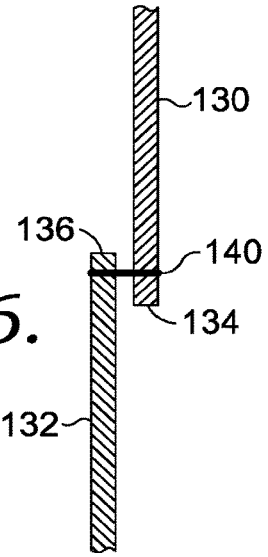
FIG. 6 illustrates a cross-section of a vent including a securement point taken along cut line 6-6 of FIG. 1 in accordance with aspects herein.

FIG. 6 illustrates a cross-section of the vent opening 138 taken along cut line 6-6 of FIG. 1. FIG. 6 illustrates the securement point 140 that secures the bottom edge 134 of the upper panel 130 to the top edge 136 of the lower panel 132 at spaced-apart locations along the vent opening 138. The securement point 140, in example aspects, may comprise a stitch as shown. In other example aspects, the securement point 140 may be formed using bonding, adhesives, releasable fasteners such as snaps, buttons, hook-and-loop fasteners, and the like.

FIG. 7 illustrates a cross-section of the vent opening 138 on the front aspect 122 of the upper-body garment 100 taken along cut line 7-7 of FIG. 2. With respect to FIG. 7, a reinforcement strip 710 is applied to an inner-facing surface 705 of the bottom edge 134 of the upper panel 130 and is used to maintain the vent opening 138 in an open state. As mentioned, the front aspect 122 of the upper-body garment 100 may be exposed to prevailing wind flow when a wearer is moving forward, and the use of the reinforcement strip 710 prevents the vent opening 138 from collapsing when exposed to the prevailing wind flow. The reinforcement strip 710 may be formed from a variety of materials including rigid materials and flexible materials such as rubber, silicone, polyurethane, thermoplastic polyurethane, wire or metal, plastic, a textile (knit, woven or non-woven), and the like.

FIG. 8 illustrates a view of the vent opening 138 of FIG. 7 taken along the longitudinal axis of the vent opening 138. In example aspects, the reinforcement strip 710 may have a permanent arch shape to facilitate maintaining the vent opening 138 in the open state. In other example aspects, the reinforcement strip 710 may be formed from a flexible material that is straight in an unbiased state. When incorporated into the vent opening 138, the flexible reinforcement strip 710 may be biased between adjacent securement points 140 to cause the reinforcement strip 710 to assume an arch shape. Any and all aspects, and any variation thereof, are contemplated as being within aspects herein.

Figure 9:
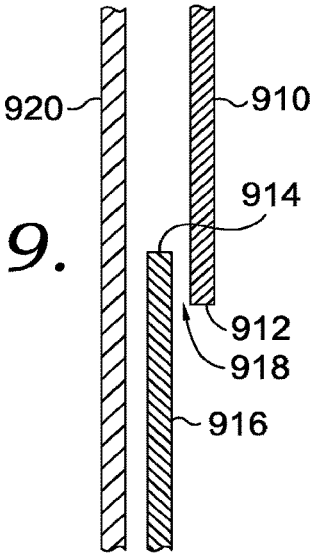
FIG. 9 illustrates an example cross-section of a vent including a mesh liner layer in accordance with aspects herein.

FIG. 9 illustrates an alternative construction where a mesh liner layer 920 is positioned internal to at least the plurality of panels 128. FIG. 9 depicts an upper panel 910 having a bottom edge 912 that overlaps a top edge 914 of a lower panel 916 to form a vent opening 918. The mesh liner layer 920 is positioned internal to the upper panel 910 and the lower panel 916. It is contemplated herein that the mesh liner layer 920 may be unaffixed from the upper panel 910 and the lower panel 916, or the mesh liner layer 920 may be tacked or secured to one or more of the upper panel 910 and the lower panel 916 at one or more locations. The mesh liner layer 920 may include a loosely knit or woven structure having a plurality of closely-spaced openings, or the mesh liner layer may include a fabric (knit, woven, non-woven) through which a plurality of holes are formed (e.g., by way of laser cutting, incising, die punch, and the like). The mesh liner layer 920 may be useful for preventing particulate matter from entering the upper-body garment by way of the vent opening 138 while still maintaining the lightweight characteristics and breathability/permeability characteristics of the upper-body garment. The mesh liner layer 920 may be limited to areas of the garment that include the panels that form the vent structure. Alternatively, the entirety or substantial entirety of the upper-body garment may be lined with the mesh liner layer in example aspects. Any and all aspects, and any variation thereof, are contemplated as being within aspects herein.

Figure 10:
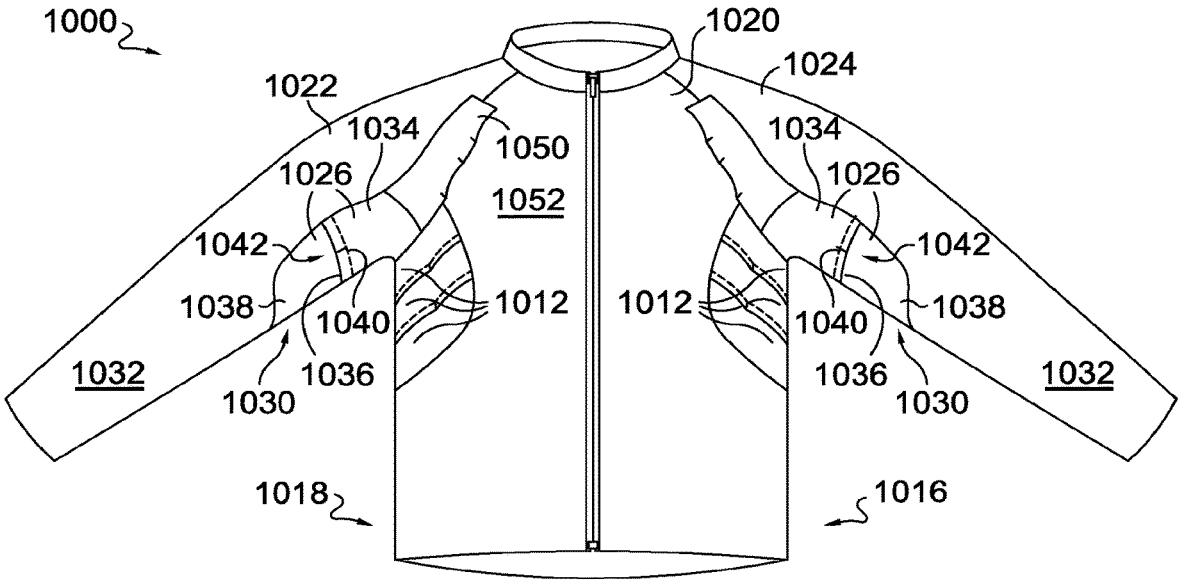
FIGS. 10-11 illustrate front and back views respectively of a vented upper-body garment that includes sleeves having vents in accordance with aspects herein.
Figure 11:
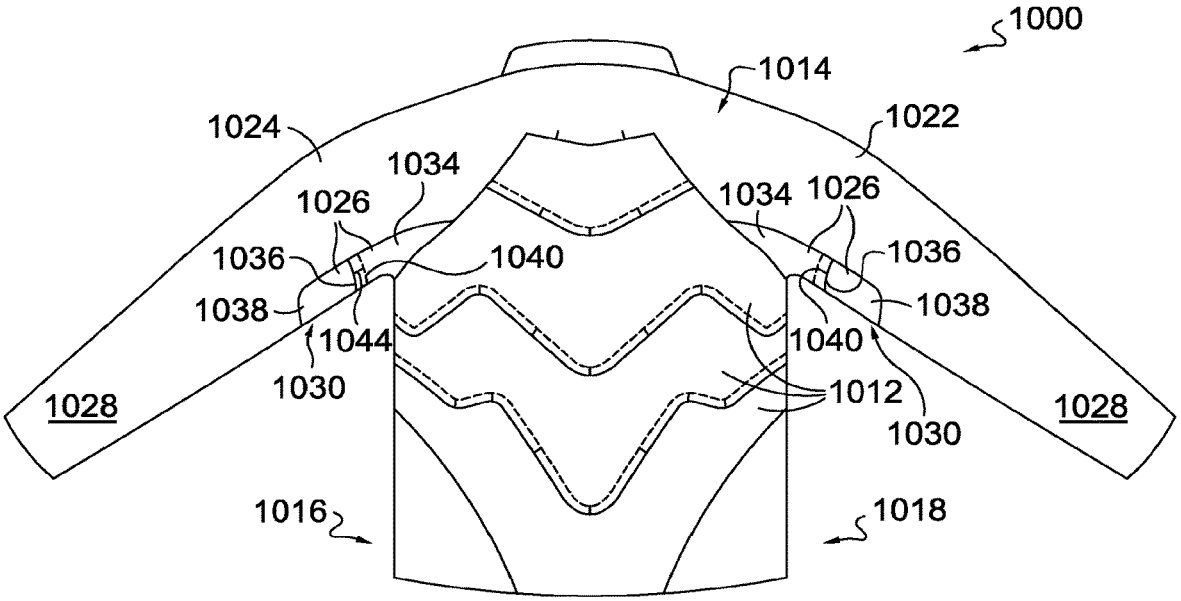

FIGS. 10 and 11 depict front and back views respectively of an upper-body garment 1000 that includes sleeves. Similar to the upper-body garment 100, the upper-body garment 1000 includes a first plurality of panels 1012 that extend across a back aspect 1014, a first side 1016, a second side 1018, and at least partially across a front aspect 1020 of a torso region of the upper-body garment 1000. The discussion regarding the plurality of panels 128 of the upper-body garment 100 is applicable to the first plurality of panels 1012 and, as such, will not be repeated.

The upper-body garment 1000 further includes a first long sleeve 1022 and a second long sleeve 1024 that extend from sleeve openings of the torso region of the upper-body garment 1000. In example aspects, each of the first long sleeve 1022 and the second long sleeve 1024 may include a second plurality of panels 1026 that extend at least partially across a back aspect 1028 of the first long sleeve 1022 and the second long sleeve 1024, around a medial aspect 1030 of the first long sleeve 1022 and the second long sleeve 1024 (the aspect that is closest to a front midline of the upper-body garment 1000) and at least partially across a front aspect 1032 of the first long sleeve 1022 and the second long sleeve 1024 to form a continuous vent structure. The second plurality of panels 1026 includes at least an upper panel 1034 positioned adjacent to an underarm area of the upper-body garment 1000 and having a bottom edge 1036 and a lower panel 1038 having a top edge 1040. The bottom edge 1036 of the upper panel 1034 overlaps the top edge 1040 of the lower panel 1038 to form a vent opening 1042. In example aspects, the bottom edge 1036 of the upper panel 1034 may be secured to the top edge 1040 of the lower panel 1038 at a plurality of spaced-apart securement points 1044. In example aspects, one or more reinforcement strips may be used on the front aspect 1032 of the first long sleeve 1022 and the second long sleeve 1024 to maintain the vent opening 1042 in an open state. Although only two panels are shown for the second plurality of panels 1026, it is contemplated herein that the second plurality of panels may include additional panels.

Positioning the second plurality of panels 1026 adjacent to the high-heat producing underarm area may facilitate the cooling of this area due to the ingress of air from the external environment by way of the vent opening 1042 on the front aspect 1032 of the first long sleeve 1022 and the second long sleeve 1024 and the removal of heated air by way of the vent opening 1042 on the back aspect 1028 of the first long sleeve 1022 and the second long sleeve 1024. It is contemplated herein that the upper-body garment 1000 may include additional vent openings formed by overlapping the edges of different panel pieces such as panel piece 1050 and panel piece 1052.

Figure 12:
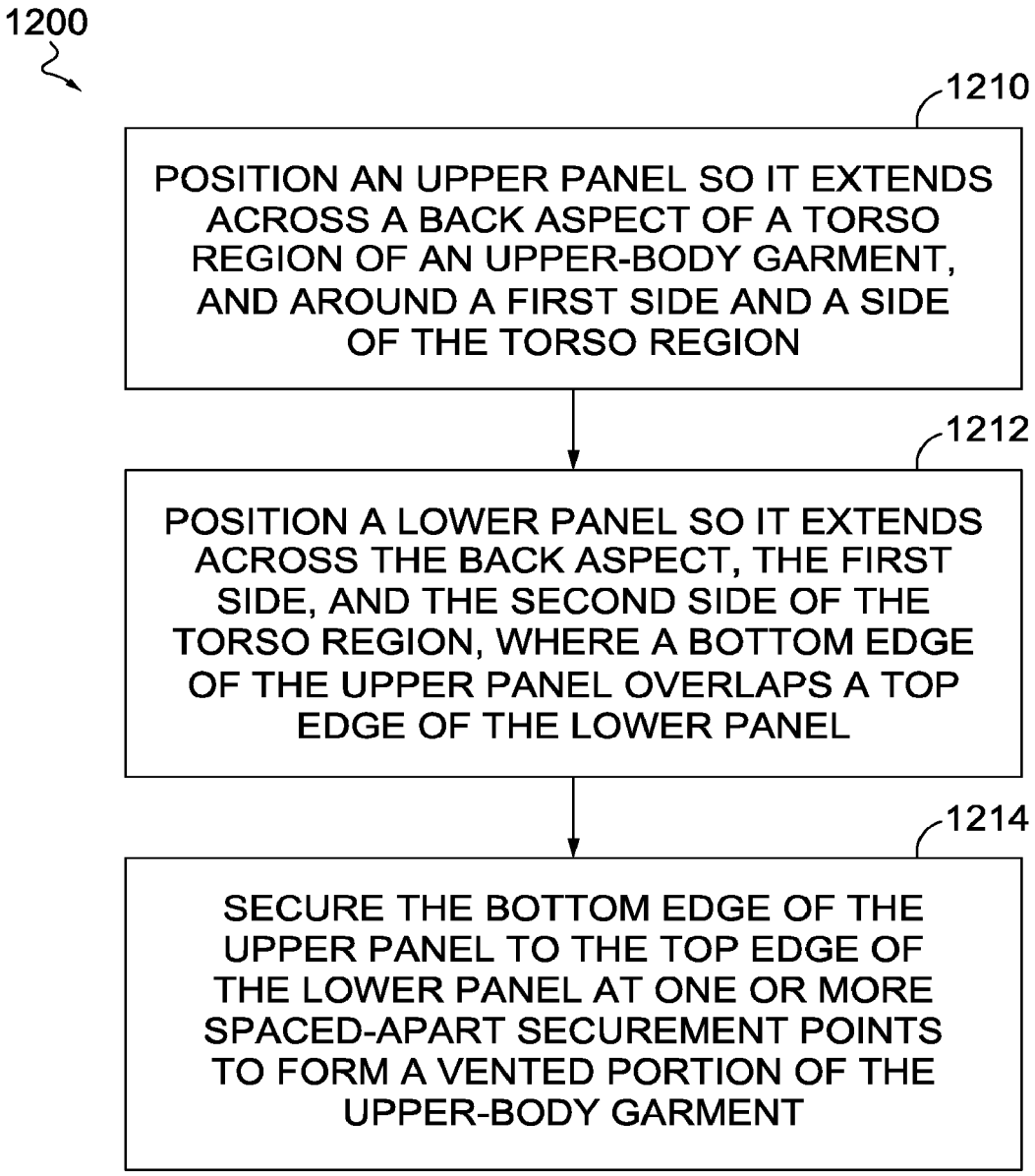
FIG. 12 illustrates a flow diagram of an example method of manufacturing a vented portion of an upper-body garment in accordance with aspects herein.

FIG. 12 depicts a flow diagram of an example method 1200 of manufacturing a vented portion of an upper-body garment such as the upper-body garment 100 or the upper-body garment 1000. The upper-body garment includes a torso region having a first sleeve opening, and a second sleeve opening. At a step 1210, an upper panel is positioned such that it extends across a back aspect of the torso region and around a first side and a second opposite side of the torso region. In example aspects, the upper panel may extend around the first side and the second side inferior to the first sleeve opening and the second sleeve opening respectively. The upper panel has a bottom edge that includes a first undulating pattern as the bottom edge extends across the back aspect.

At a step 1212, a lower panel is positioned such that it extends across the back aspect of the torso region and around the first side and the second opposite side of the torso region. The lower panel has a top edge that includes a second undulating pattern as the top edge extends across the back aspect. The upper panel and the lower panel are positioned so that the bottom edge of the upper panel overlaps the top edge of the lower panel to form a vent opening. At a step 1214, the bottom edge of the upper panel is secured to the top edge of the lower panel at one or more spaced-apart securement points to form the vented portion of the upper-body garment.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper-body garment with a torso region having a first sleeve opening, and a second sleeve opening, the upper-body garment comprising:

a plurality of panels forming one or more inflow vents and one or more outflow vents, the plurality of panels extending across a back aspect of the torso region, around a first side and a second opposite side of the torso region inferior to the first sleeve opening and the second sleeve opening respectively, and across at least a portion of a front aspect of the torso region, each of the plurality of panels including a first terminal end and a second terminal end, wherein:

the plurality of panels comprises an upper panel having a bottom edge and a lower panel comprises a top edge;

the bottom edge and the top edge overlap one another on at least part of the front aspect of the upper-body garment;

on the front aspect of the upper-body garment, the bottom edge and the top edge angle upwards as they extend from the first side towards a front midline of the upper-body garment;

at least a first front panel extending across a first reference line that passes through the first terminal end of at least one of the plurality of panels and is parallel to the front midline of the upper-body garment; and wherein at least a portion of the bottom edge and the top edge that angle upwards extend superior to a bottom edge of the first armhole.

2. The upper-body garment of claim 1, further comprising a second front panel extending across a second reference line that passes through the second terminal end of the at least one of the plurality of panels and is parallel to the front midline of the upper-body garment.

3. The upper-body garment of claim 1, wherein the bottom edge of the upper panel overlaps the top edge of the lower panel to form a vent opening between the bottom edge and the top edge, at least a portion of the vent opening being on the first side and directly inferior to a bottom margin of the first sleeve opening and between the first sleeve opening and a waist opening of the upper-body garment.

4. The upper-body garment of claim 3, wherein the bottom edge of the upper panel includes a first undulating pattern in the form of a wave with at least a first trough and a second trough as the bottom edge extends across the back aspect of the torso region, with the first trough being lower than the second trough, and wherein the top edge of the lower panel includes a second undulating pattern as the top edge extends across the back aspect of the torso region, the second undulating pattern being substantially the same as the first undulating pattern.

5. The upper-body garment of claim 3, further comprising a plurality of spaced-apart securement points between the bottom edge of the upper panel and the top edge of the lower panel, the plurality of spaced-apart securement points subdividing the vent opening into a plurality of sub-vent openings, at least one sub-vent opening being on the first side and directly inferior to the first sleeve opening.

6. The upper-body garment of claim 5, wherein a first sub-vent opening of the plurality of sub-vent openings comprises a reinforcement strip extending along a portion of the bottom edge of the upper panel, the reinforcement strip maintaining the first sub-vent opening in an open state.

7. The upper-body garment of claim 6, wherein the first sub-vent opening is located on the front aspect of the upper-body garment.

8. The upper-body garment of claim 6, wherein a longitudinal axis of the first sub-vent opening is oriented substantially parallel to the front midline of the upper-body garment.

9. An upper-body garment with a torso region having a first sleeve opening, and a second sleeve opening, the upper-body garment comprising:

an upper panel having a bottom edge, which continuously extends across an entirety of a back aspect of the torso region, around a first side of the torso region, and to a front aspect of the torso region;

a lower panel having a top edge, which extends across the entirety of the back aspect of the torso region, around the first side of the torso region, and to the front aspect of the torso region, wherein the bottom edge of the upper panel overlaps the top edge of the lower panel to form a vent opening that is between the bottom edge and the top edge and that includes a first vent on the front aspect of the torso region and a second vent on the back aspect of the torso region, and wherein at least a portion of the first vent is superior to the entirety of the second vent; and at least a first front panel extending across a first reference line that passes through a first terminal end of the lower panel and is parallel to a front midline of the upper-body garment, wherein the first front panel is omitted from a space behind the first vent and the second vent, such that there is no intervening panel between the first vent and the second vent.

10. The upper-body garment of claim 9, wherein the vent opening comprises a third vent positioned inferior to the first sleeve opening.

11. The upper-body garment of claim 9, wherein at least the lower panel further includes a second terminal end, and wherein the first terminal end and the second terminal end are located on the front aspect of the torso region.

12. The upper-body garment of claim 11, wherein the first terminal end is spaced from the front midline of the upper-body garment by the first front panel, and wherein the second terminal end is spaced from the front midline of the upper-body garment by a second front panel.

13. The upper-body garment of claim 12, wherein the second front panel extends across a second reference line that passes through the second terminal end and is parallel to the front midline of the upper-body garment.

14. The upper-body garment of claim 9, further comprising a plurality of spaced-apart securement points between the bottom edge of the upper panel and the top edge of the lower panel, the plurality of spaced-apart securement points subdividing the vent opening into a plurality of sub-vent openings, at least one sub-vent opening being on the first side and directly inferior to the first sleeve opening.

15. The upper-body garment of claim 14, wherein the plurality of sub-vent openings include a first sub-vent opening positioned on the front aspect of the upper-body garment, and wherein a longitudinal axis of the first sub-vent opening is oriented substantially parallel to the front midline of the upper-body garment.

16. The upper-body garment of claim 15, wherein the first sub-vent opening comprises a reinforcement strip extending along a portion of the bottom edge of the upper panel, the reinforcement strip maintaining the first sub-vent opening in an open state.

17. A method of manufacturing a vented portion of an upper-body garment with a torso region having a first sleeve opening, and a second sleeve opening, the method of manufacturing comprising:

positioning an upper panel such that it extends across a back aspect of the torso region and around a first side and a second opposite side of the torso region, the upper panel having a bottom edge that includes a first undulating pattern in the form of a wave with at least a first trough and a second trough as the bottom edge extends across the back aspect, the first trough being lower than the second trough;

positioning a lower panel such that it extends across the back aspect of the torso region and around the first side and the second opposite side of the torso region, the lower panel having a top edge that includes a second undulating pattern as the top edge extends across the back aspect, wherein the upper panel and the lower panel are positioned so that the bottom edge of the upper panel overlaps the top edge of the lower panel to form a vent opening;

securing the bottom edge of the upper panel to the top edge of the lower panel at one or more spaced-apart securement points to form the vented portion of the upper-body garment; and positioning a first front panel so that it is omitted from a space behind the vent opening and it extends across a first reference line that passes through a first terminal end of the lower panel and is parallel to a front midline of the upper-body garment.

18. The method of manufacturing the vented portion of the upper-body garment of claim 17, wherein each of the upper panel and the lower panel extend around the first side and the second opposite side of the torso region inferior to the first sleeve opening and the second sleeve opening respectively.

19. The method of manufacturing the vented portion of the upper-body garment of claim 17, wherein the first undulating pattern is substantially the same as the second undulating pattern.

* * * * *